US010145625B2

(12) United States Patent
Persson

(10) Patent No.: US 10,145,625 B2
(45) Date of Patent: Dec. 4, 2018

(54) DIMPLE PATTERN GASKETED HEAT EXCHANGER

(71) Applicant: Danfoss A/S, Nordborg (DK)

(72) Inventor: Lars Persson, Guizhou (CN)

(73) Assignee: DANFOSS A/S, Nordborg (DK)

( * ) Notice: Subject to any disclaimer, the term of this patent is extended or adjusted under 35 U.S.C. 154(b) by 231 days.

(21) Appl. No.: 14/196,209

(22) Filed: Mar. 4, 2014

(65) Prior Publication Data

US 2014/0251586 A1 Sep. 11, 2014

(30) Foreign Application Priority Data

Mar. 8, 2013 (DK) ..... 2013 00120

(51) Int. Cl.
*F28F 3/04* (2006.01)
*F28F 3/08* (2006.01)

(52) U.S. Cl.
CPC ..... *F28F 3/044* (2013.01); *F28F 3/083* (2013.01)

(58) Field of Classification Search
CPC .. F28F 3/044; F28F 3/083; F28F 3/025; F28F 3/08; F28F 3/046; F28F 3/10; F28F 2265/14; F28F 2265/26; F28D 9/0037; F28D 9/0087; F28D 9/0062; F28D 9/0068; F28D 9/0012; F28D 9/0043; F28D 9/005; E04C 2002/3411; E04C 2002/3416; E04C 2002/3422; E04C 2002/3427; E04C 2002/3433; E04C 2002/3438
USPC .... 52/789.1, 850, 740.2, FOR. 165; 428/604
See application file for complete search history.

(56) References Cited

U.S. PATENT DOCUMENTS 2,281,754 A 5/1942 Dalzell
2,441,476 A * 5/1948 Ewald ..... B21D 13/04 29/897.2
2,481,046 A * 9/1949 Scurlock ..... E04C 2/3405 219/78.12
2,577,321 A * 12/1951 Filger ..... B65D 47/18 128/200.22
2,627,283 A 2/1953 Przyborowski
(Continued)

FOREIGN PATENT DOCUMENTS

EP 1122505 A1 8/2001
EP 1933105 A1 * 6/2008 ..... F28D 9/0043
(Continued)

OTHER PUBLICATIONS

Danish Search Report for Serial No. PA 2013 00120 dated Oct. 16, 2013.
(Continued)

*Primary Examiner* — Orlando E Aviles Bosques
*Assistant Examiner* — Jose O Class-Quinones
(74) *Attorney, Agent, or Firm* — McCormick, Paulding & Huber LLP

(57) ABSTRACT

The invention relates to a gasketed heat exchanger including a plurality of heat exchanger plates, wherein each of the heat exchanger plates has a plurality of dimples. The dimples have tops and bottoms. Furthermore, the tops of at least one heat exchanger plate are connected to the bottoms of another neighboring heat exchanger plate. In order to prevent plastic deformations of the heat exchanger plates under external forces and internal fluid pressures the dimples are elastically deformable.

14 Claims, 6 Drawing Sheets

(56) References Cited

U.S. PATENT DOCUMENTS

| | | | | | |
|---|---|---|---|---|---|
| 3,597,891 | A * | 8/1971 | Martin | B62D 29/04 | 428/178 |
| 3,664,928 | A | 5/1972 | Roberts | | |
| 3,742,663 | A * | 7/1973 | Duskin | E04B 1/86 | 428/178 |
| 3,783,090 | A | 1/1974 | Andersson et al. | | |
| 3,956,543 | A * | 5/1976 | Stangeland | F02K 9/605 | 220/560.06 |
| 4,471,759 | A | 9/1984 | Anderson et al. | | |
| 4,630,674 | A * | 12/1986 | Skoog | F28D 9/005 | 165/147 |
| 4,781,248 | A * | 11/1988 | Pfeiffer | F28D 9/005 | 165/166 |
| 4,919,200 | A | 4/1990 | Glomski et al. | | |
| 5,398,751 | A | 3/1995 | Blomgren | | |
| 5,643,656 | A | 7/1997 | Lin | | |
| 5,968,321 | A * | 10/1999 | Sears | B01D 1/221 | 159/24.1 |
| 6,155,338 | A | 12/2000 | Endou et al. | | |
| 6,221,463 | B1 * | 4/2001 | White | B01D 53/885 | 165/166 |
| 6,357,516 | B1 * | 3/2002 | Judge | F28F 3/083 | 165/166 |
| 8,091,619 | B2 | 1/2012 | Persson | | |
| 2003/0029608 | A1 | 2/2003 | Shimoya | | |
| 2007/0006998 | A1 * | 1/2007 | Brost | F28D 9/005 | 165/167 |
| 2007/0261829 | A1 * | 11/2007 | Persson | F28F 3/04 | 165/165 |
| 2011/0036547 | A1 * | 2/2011 | Christensen | F28D 9/005 | 165/166 |
| 2011/0088882 | A1 | 4/2011 | Persson | | |
| 2011/0120934 | A1 | 5/2011 | Siverklev | | |
| 2011/0180247 | A1 * | 7/2011 | Persson | F28F 3/044 | 165/185 |
| 2014/0251587 | A1 | 9/2014 | Persson | | |

FOREIGN PATENT DOCUMENTS

| | | | | |
|---|---|---|---|---|
| GB | 901914 | A * | 7/1962 | F28D 9/0037 |
| GB | 1468514 | | 3/1977 | |
| JP | 4072876 | B2 | 4/2008 | |
| RU | 2164332 | C2 | 3/2001 | |
| SU | 1257402 | A2 | 9/1986 | |
| WO | 8808508 | A1 | 11/1988 | |
| WO | 9300563 | A1 | 1/1993 | |
| WO | 9712189 | A1 | 4/1997 | |
| WO | 02053998 | A1 | 7/2002 | |
| WO | 2009112031 | A2 | 9/2009 | |

OTHER PUBLICATIONS

European Search Report Serial No. EP14153900 dated Jul. 17, 2015.

European Search Report Serial No. EP14153906 dated Jul. 20, 2015.

Danish Search Report for Serial No. PA 2013 00126 dated Oct. 16, 2013.

* cited by examiner

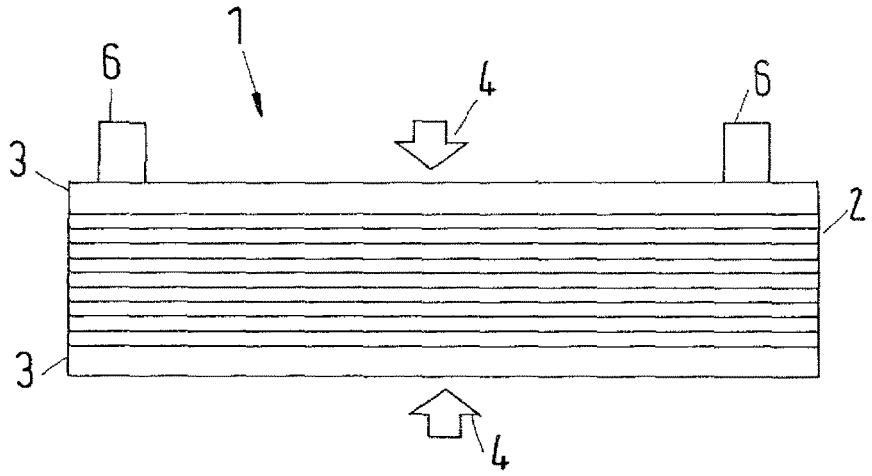
Fig.1
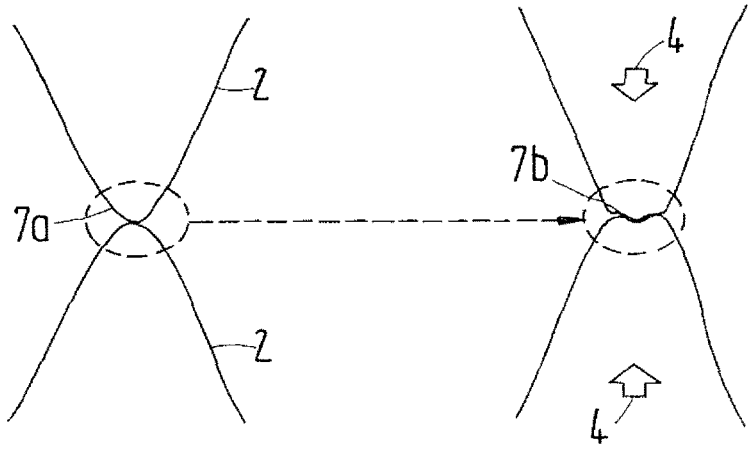
Fig.2A
Prior Art
Fig.2B
Prior Art

DIMPLE PATTERN GASKETED HEAT EXCHANGER

CROSS REFERENCE TO RELATED APPLICATION

Applicant hereby claims foreign priority benefits under U.S.C. § 119 from Danish Patent Application No. PA 2013 00120 filed on Mar. 8, 2013, the contents of which are incorporated by reference herein.

TECHNICAL FIELD

The invention relates to a gasketed heat exchanger comprising a plurality of heat exchanger plates, wherein each of the heat exchanger plates comprises a plurality of dimples, and wherein the dimples comprise tops and bottoms, and wherein the tops of at least one heat exchanger plate are connected to the bottoms of another neighboring heat exchanger plate.

BACKGROUND

Plate heat exchangers are well known devices for the transfer of heat between two different media, in particular fluids. Plate heat exchangers usually comprise a plurality of heat exchanger plates, wherein each heat exchanger plate comprises a pattern of indentations as well as inlets and outlets for the two media. Each pair of neighboring plates is joined in such a way that channels for the transport of the separate media are created. The two media will then be allowed to circulate between alternating pairs of plates to allow a transfer of heat through the heat exchanger plates. The pattern of indentations of one plate will be in contact with the indentation patterns of the two neighboring plates. This way the plates are kept slightly spaced and the shape of the fluid paths can be adjusted to improve the efficiency of the heat exchange.

In the state of the art, it is common to use a so called herringbone pattern of indentations comprising ridges and valleys that force the flow of the media to accelerate and decelerate repeatedly within the plane of the heat exchanger plate. This usually leads to a large variation of the flow rate of the fluids which reduces the effectiveness of the heat transfer. Thus, a pattern of indentation that allows for a more homogeneous flow of the fluids would be beneficial.

There are furthermore two important types of heat exchangers known in the state of the art, namely brazed heat exchangers and gasketed heat exchangers. Since the fluids in the heat exchanger will usually be provided under a large pressure, one needs to ensure that the plates of the heat exchanger are held firmly together. In a brazed heat exchanger each two neighboring heat exchanger plates are brazed together where the indentation patterns meet. On the other hand, in a gasketed heat exchanger the plates are kept under tension by external forces, for example by introducing bolds through bores of the plates. Consequently, in a gasketed heat exchanger the heat exchanger plates are kept under a pretension.

In order to improve the efficiency of the heat exchange, it has been tried to reduce the surface area used as contact surface of the neighboring heat exchanger plates or to reduce the thickness of the heat exchanger plates.

In U.S. Pat. No. 8,091,619 B2 a heat exchanger of the type mentioned above is disclosed. Therein the herringbone pattern of indentations is replaced by a plurality of dimples, comprising tops and bottoms. The flat tops of one plate are brazed together with the flat bottoms of a neighboring plate. Thus, the stability of such a brazed heat exchanger can be improved allowing to reduce the thickness of the heat exchanger plates. At the same time the surface area at which each two neighboring plates meet is optimized. Thus, the efficiency of such a brazed heat exchanger is improved.

In case of a gasketed heat exchanger such a construction may be problematic. Gasketed heat exchangers have the additional problem of plastic deformation at the contact areas of the heat exchanger plates. Such deformations occur partly due to the heat exchanger plates being kept under a pre-tension, and due to the relative pressure difference of the fluids. This may result in plastic deformations at the contact areas of the heat exchanger plates where such plastic deformations may form a bypass for the fluids especially if the relative pressures of the fluids changes, resulting in a lower performance of the heat exchanger.

SUMMARY

Consequently, the task of the invention is to provide a gasketed heat exchanger that has an improved efficiency of heat exchange while still being more resistant to forces caused by the pre-tension as well as the internal fluid pressures.

The present invention solves the above problem in that the dimples are elastically deformable, (or in alternative wording elastically compressible), in the context meaning that they may change shape slightly due to a bending of the wall material, but that this it is reversible.

Thus, the dimples are able to deform reversibly. Permanent deformations of the heat exchanger plates at their contact surfaces that may result in a reduced performance are avoided. The forces acting on the contact surfaces of the tops and bottoms of the dimples will change strongly within a gasketed heat exchanger. On the one hand, the forces pressing the contact surfaces of the tops and bottoms together are constant and caused by the pre-tension. On the other hand, the forces acting to separate the heat exchanger plates can vary strongly due to different internal pressures of the two media. Thus, the resulting net force acting on the contact surfaces of the tops and bottoms can change strongly. By making the dimples elastically deformable the dimples can deform under the pretension, which will result in an additional spring force that can counteract the pretension forces. Thus, a plastic deformation of the contact surfaces of the heat exchanger plates is avoided. At the same time the efficiency of the heat exchanger can be improved by reducing the total area of the contact surfaces and/or the thickness of the heat exchanger plates.

In contrast to that in a brazed heat exchanger according to the state of the art, the contact surfaces of the tops and bottoms will be brazed together, resulting in a rigid connection of the dimples.

It is preferable if the tops and bottoms are elastically deformable. In particular, the tops and bottoms should be elastically deformable in a direction perpendicular to the plane of the heat exchanger plates. Thus, even when the forces acting on the contact surfaces of the tops and bottoms may be asymmetric, this will not result in a permanent deformation.

It is furthermore preferred that the dimples comprise flanks that are elastically deformable. Consequently, the contact surfaces of two connected dimples can move due to elastic deformations of the flanks of the dimples. This way, additional spring forces can be generated if the external forces, in particular caused by the fluid pressures, change.

It is also preferred that the flanks are substantially straight between adjacent tops and bottoms. This way it is ensured that the dimples are strong enough to support the mechanical forces acting upon them, while at the same time being able to elastically deform, if the net forces acting on them should become too large.

It is preferable if the flanks are substantially tangent-shaped between adjacent tops and bottoms. As an alternative to straight flanks, tangent-shaped flanks may be less stable but are also easier to deform elastically. Which embodiment may be preferable will thus depend on the application as well as the chosen material and thickness of the heat exchanger plates.

In another preferred embodiment the dimples comprising tops are arranged in first rows and the dimples comprising bottoms are arranged in second rows. This way one may arrange the dimples in patterns that are particularly beneficial for the fluid flow between each two heat exchanger plates. In particular it is possible to make the fluid flow reach all parts of the heat exchanger plates resulting in a higher efficiency of the heat exchanger.

In another preferred embodiment at least part of the first and second rows are arranged parallel to an edge of the heat exchanger plate. Thus, one may for example ensure that the fluids will also flow towards the edges of the heat exchanger plates resulting in a more homogeneous fluid flow across the whole area of the heat exchanger plates.

It is also preferred that at least part of the first and second rows are arranged at an angle to an edge of the heat exchanger plates. In particular, some of the first and second rows may be arranged at an angle of 20° to less than 45° to an edge of the heat exchanger plate. This way it is ensured that the fluid flow can be efficiently directed towards all parts of the heat exchanger plates without too abrupt changes of the direction of the fluid flow.

It is furthermore preferred that the first and second rows change direction within the plane of the heat exchanger plate. Consequently, there should be no direct paths for the fluid flow from an inlet to an outlet across the heat exchanger plates.

In another preferred embodiment at least part of the first and second rows form wedges in the plane of the heat exchanger plate. Thus it is ensured that the fluid flow can be guided effectively by the dimple pattern.

In another preferred embodiment the gasketed heat exchanger comprises top plate and a bottom plates, wherein the plurality of heat exchanger plates are arranged between the top and the bottom plates, and wherein the heat exchanger plates are held together under a pre-tension by the top and the bottom plates. Thus, the before mentioned pre-tension will be achieved in this embodiment by pressing the top plate and the bottom plate towards each other, for example by introducing bolds through bores in the top and bottom plate as well as in the heat exchanger plates.

BRIEF DESCRIPTION OF THE DRAWINGS

The invention will now be described in detail below with reference to the attached drawings, of which:

FIG. 1 is a cut view of a heat exchanger according to the invention,

FIGS. 2*a*, 2*b*, 3 show a plastic deformation of a contact area of two heat exchanger plates according to the state of the art.

DETAILED DESCRIPTION

Figure 3:
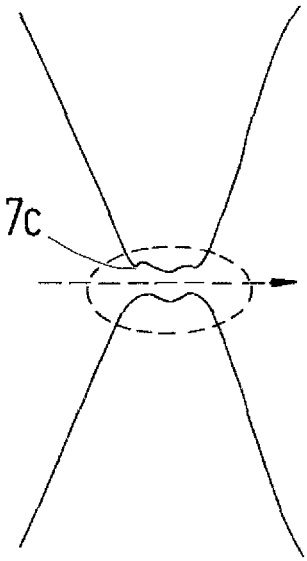
Fig.3 Prior Art

In FIG. 1 a cut view of a heat exchanger 1 comprising a plurality of heat exchanger plates 2 is shown. The heat exchanger plates 2 are stacked on top of each other creating a plurality of fluid paths between them. The heat exchanger plates 2 are arranged between top and bottom plates 3 by means of forces 4. Consequently, the heat exchanger plates 2 are held under a pre-tension by an external pressure. The forces 4 can for example be introduced by connecting the top and bottom plates 4 by way of introducing bolds through bores in the top and bottom plate 3 as well as the heat exchanger plates 2.

Between each pair of heat exchanger plates 2 a gasket 5 is arranged to seal the two fluids to the outside as well as separate the two fluid from each other. The heat exchanger 1 will usually be supplied with pairs of inlets and outlets 6.

In FIGS. 2*a*, 2*b* and 3, a problem of heat exchangers according to the state of the art is disclosed. FIG. 2*a* therein shows a contact area 7*a* of two heat exchanger plates 2. According to the state of the art, the contact area is in this case formed by a valley of a top plate meeting a ridge of a bottom plate. In order to improve the heat exchange, the contact area of the two neighboring heat exchanger plates is chosen to be very small.

According to FIG. 2*b* forces 4 as mentioned earlier will now press the two neighboring heat exchanger plates 2 together, which may result in a plastic deformation of the very small contact area 7*b*. In FIG. 3 the contact area 7*c* is shown again after the forces 4 have either vanished or have been reduced, for example due to a change of the internal fluid pressures. In this case, the two neighboring heat exchanger plates 2 are permanently deformed and do no longer stay in contact in the area 7*c*. This may result in a bypass for the fluid flow. This in turn will usually reduce the efficiency of the heat exchanger, because more direct fluid paths from the inlet to the outlets may open up which will result in the fluid flow no longer being evenly distributed between the two heat exchanger plates.

Figure 4:
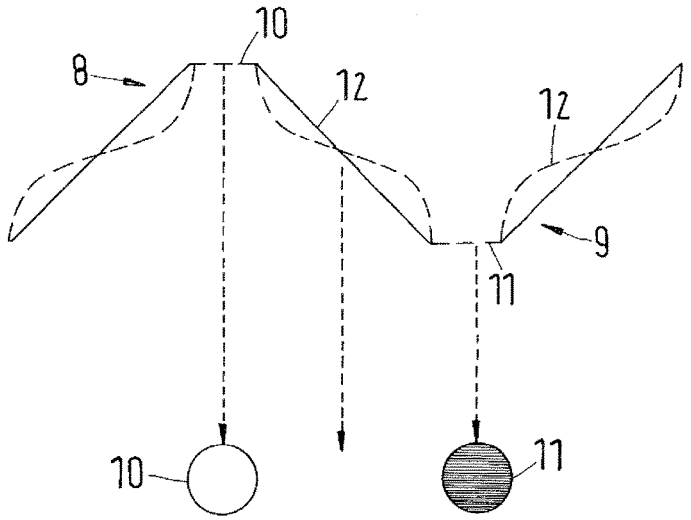
FIG. 4 shows a cross-section through a heat exchanger plate according to the invention.

FIG. 4 now shows a cut view of a heat exchanger plate according to the invention. Here the heat exchanger plates 2 comprise dimples 8, 9 which protrude in directions perpendicular to the plane of the heat exchanger plate 2. In this case, the dimple 8 comprises a top 10 and the dimple 9 comprises a bottom 11. The top 10 as well as the bottom 11 are in this particular embodiment flat surfaces at the ends of the corresponding dimples 8, 9. The lower part of FIG. 4 here shows a top view of the top 10 and the bottom 11, which here both have a circular shape. Of course, different shapes of the tops 10 and the bottoms 11 are also possible, for example an oval or a rectangular shape. Furthermore, the tops 10 and the bottoms 11 do not necessarily have to be flat, one only has to ensure that the tops 10 and the bottoms 11 of neighboring heat exchanger plates 2 fit together.

The dimples 8, 9 furthermore comprise flanks 12. In this particular cut view, the flanks 12 directly connect a dimple 8 comprising a top 10 with a dimple 9 comprising a bottom 11. Here two different embodiments are shown. The solid lines show dimples 8, 9 with substantially straight flanks 12 while the dashed lines show dimples 8, 9 with substantially tangent-shaped flanks 12. Either way it is ensured that the dimples 8, 9 are elastically deformable. The flanks 12 may have one of these shapes between adjacent tops 10 and bottoms 11, but around the circumference of the dimples 8, 9 the shape of the flanks 12 may be different as shown later on.

Figure 5:
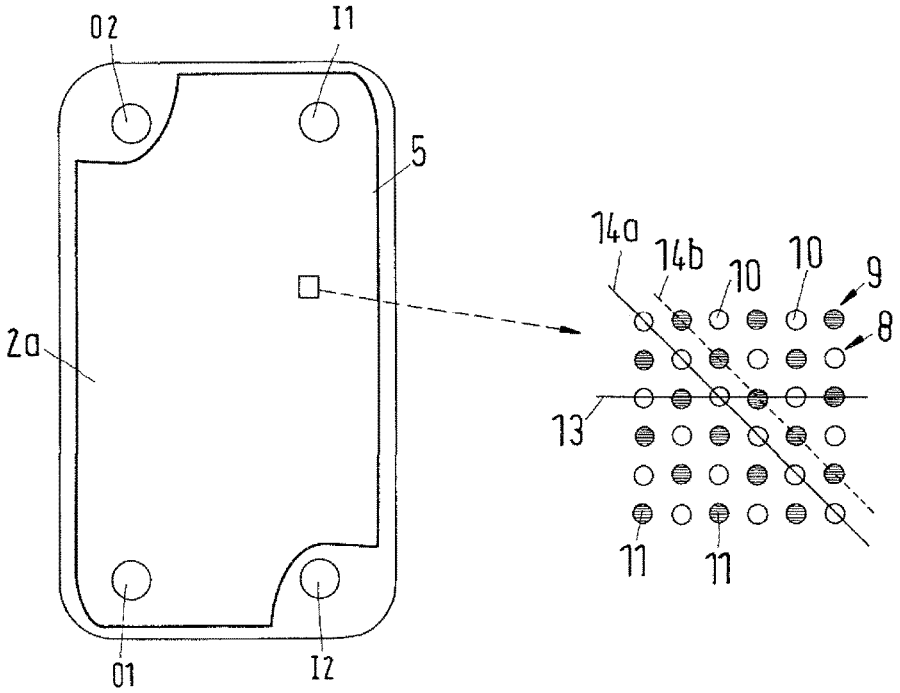
FIG. 5 shows a top view of a heat exchanger plate according to the invention as well a pattern of dimples on said heat exchanger plate.

FIG. 5 shows a top view of a heat exchanger plate 2. This figure also shows how the separation of the two fluids in the heat exchanger 1 is achieved by the gaskets 5. In this case a first fluid can enter the fluid pathways adjacent to the top of the plate 2 via the inlet I1 and flow through a plurality of fluid pathways to the outlet O1. At the same time, the second fluid cannot enter the space adjacent to the top of the heat exchanger plate 2, because the inlet I2 as well as the outlet O2 are separated from these fluid pathways by the gasket 5. On top of the next heat exchanger plate 2 the situation will be reversed and the second fluid can flow from an inlet I2 to an outlet O2 while the first fluid as well an corresponding first inlet I1 and a first outlet O1 will be separated from the fluid pathways on top of that heat exchanger plate 2 by another gasket 5.

FIG. 5 furthermore shows on the right side an enlarged view of a pattern of dimples in the heat exchanger plate 2. Similar to FIG. 4 dimples 8 comprising tops 10 are represented as unfilled circles while dimples 9 comprising bottoms 11 are represented as filled circles. Furthermore, three different directions of cut views 13, 14*a* and 14*b* are shown as solid or dashed lines. The corresponding cut views are shown in FIGS. 6*a* and 6*b*.

Figure 6A:
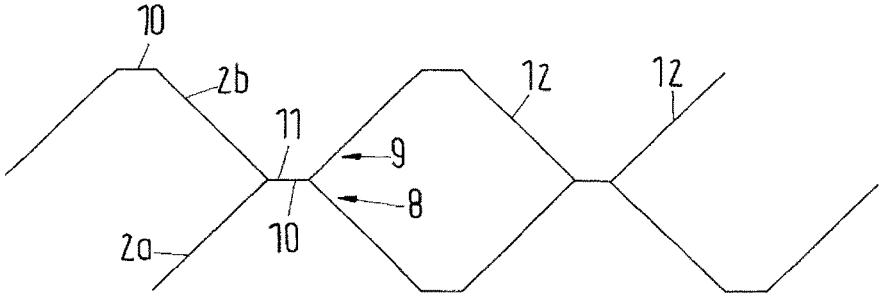
FIG. 6*a* shows a cross-section through two neighboring heat exchanger plates.

In FIG. 6*a* the cut view 13 is shown through two neighboring heat exchanger plates 2*a*, 2*b*. Along the cut view 13 dimples 8 comprising tops 10 are alternating with dimples 9 comprising bottoms 11. In this cut view 13 the flanks 12 are again substantially straight, but substantially tangent-shaped flanks may be used alternatively.

By forming such elastically deformable dimples 8, 9 comprising tops 10 and bottoms 11 as contact platforms for the heat exchanger plates 2, plastic deformations of the heat exchanger plates 2 will be avoided. At the same time, the thickness of the heat exchanger plates 2 may be reduced significantly without risking damages of the type explained in FIGS. 2*a*, 2*b* and 3. Consequently, by reducing the thickness of the heat exchanger plates 2 one may improve the heat transfer from one fluid to the other, thus achieving a better efficiency of the heat exchanger 1.

Figure 6B:
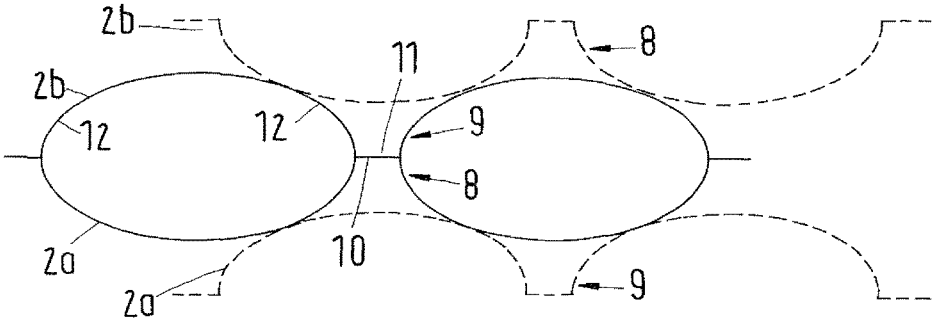
FIG. 6*b* shows two different cross-sections of two neighboring heat exchanger plates.

FIG. 6*b* shows two neighboring heat exchanger plates 2*a*, 2*b* along the cut views 14*a* and 14*b*. In this case the solid lines show the cut view 14*a* while the dashed lines show the cut view 14*b*. Along the cut view 14*a* the top heat exchanger plate 2*b* only shows dimples 9 comprising bottoms 11, while the bottom heat exchanger plate 2*a* only shows dimples 8 comprising tops 10. Again the bottoms 11 of the top heat exchanger plate 2*b* are in contact with the tops 10 of the bottom heat exchanger plate 2*a*. On the other hand, along the cut view 14*b* the top heat exchanger plate 2*b* only shows dimples 8 comprising tops 10 while the bottom heat exchanger plate 2*a* only shows dimples 9 comprising bottoms 11. Thus, along the cut view 14*b* the heat exchanger plates 2*a* and 2*b* do not show any contact areas.

FIG. 6*b* furthermore shows that the flanks 12 of the dimples 8, 9 along the cut views 14*a*, 14*b* may be substantially elliptical-shaped between adjacent tops 10 and between adjacent bottoms 11. Thus, the shape of the flanks 12 may for example change smoothly from a substantially straight or substantially tangent-shaped form to a substantially elliptical-shaped form when going around the circumference of a dimple 8, 9.

Figure 7:
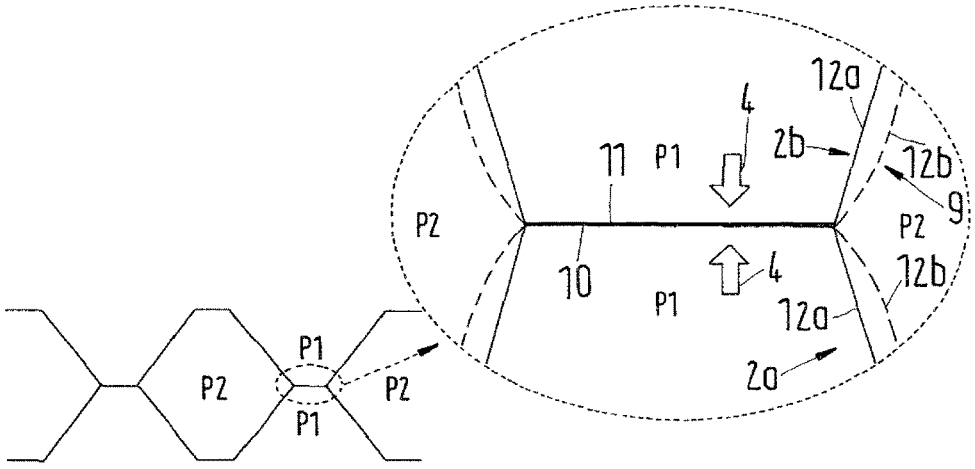
FIG. 7 shows the elastic deformation of a pair of dimples in contact with each other.

FIG. 7 shows an elastic deformation of a pair of dimples 8, 9 in contact with each other at a top 10 and a bottom 11. FIG. 7 shows a situation in which the forces 4 pressing the heat exchanger plates 2*a*, 2*b* together are of similar or equal size. This will usually be the case, since forces 4 resulting in part from the difference of a first pressure P1 of a first medium to a second pressure P2 of a second medium will be equally large in "upward" and in "downward" direction.

The flanks 12 will deform elastically from a non-deformed shape 12*a* shown by solid lines into a elastically deformed shape 12*b* shown by dashed lines. The elastic deformations of the flanks 12 as well as the tops 10 and bottoms 11 will result in spring forces acting against the external forces 4. Once the external forces 4 are reduced, the elastically deformed dimples 8, 9 will revert to their non-deformed shapes. Consequently, permanent deformations of the contact areas of the heat exchanger plates 2 as shown in FIGS. 2*a*, 2*b* and 3 will be prevented by making the dimples elastically deformable.

Figures 8A, 8B, 8C:
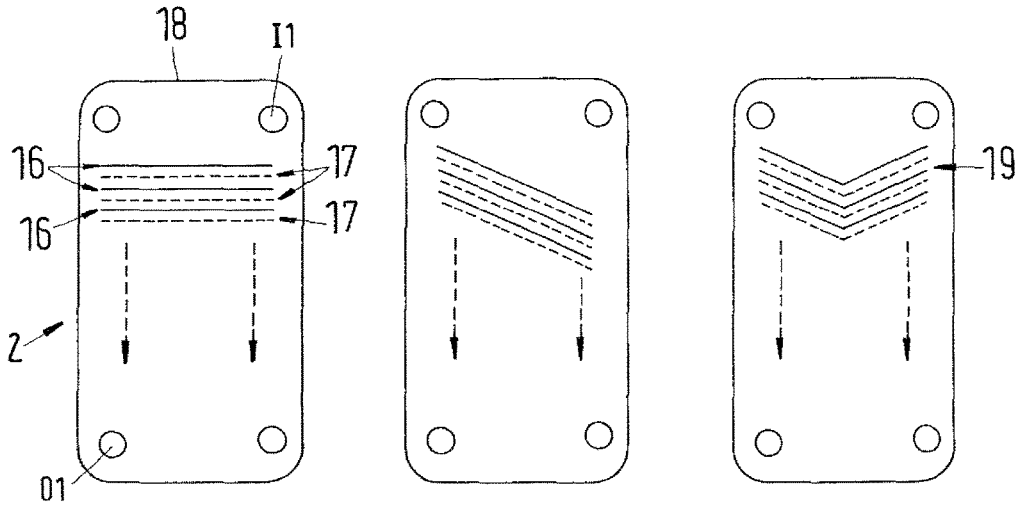
FIGS. 8*a*, 8*b*, 8*c* show three different kinds of patterns of first and second rows of dimples on a heat exchanger plate.

FIGS. 8*a*, 8*b* and 8*c* show different possible patterns of dimples 8, 9 in a heat exchanger plate 2 according to the invention. In FIG. 8*a* first rows 16 are shown along which dimples 8 comprising tops 10 are arranged. At the same time, second rows 17 are shown along which dimples 9 comprising bottoms 11 are arranged. According to the embodiment of FIG. 8*a*, at least part of the first rows 16 as well as the second rows 17 are arranged parallel to an edge 18 of the heat exchanger plate 2.

According to the embodiment shown in FIG. 8*b* at least part of the first and second rows 16, 17 are arranged at an angle to the edge 18 of the heat exchanger plate 2. In this case, the angle is for example chosen to be in the range of 20° to less than 45°. Depending on the length and width of the heat exchanger plates 2, one may thus make sure that the fluid flow has to spread out over the whole plane of the heat exchanger plates improving the efficiency of the heat transfer. In particular, direct pathways from the first inlet I1 to the first outlet O1 can thus be prevented.

According to the embodiment shown in FIG. 8*c* part of the first and second rows 16, 17 form wedges 19 in the plane of the heat exchanger plate. Consequently, the first and second rows 16, 17 change direction in the plane of the heat exchanger plate 2. The first and second rows may also change direction several times within the plane of the heat exchanger plate 2, for example forming zigzag lines. This way one may ensure that the fluid has to change direction at least several times when flowing from the first inlet I1 to the first outlet O1.

While the present invention has been illustrated and described with respect to a particular embodiment thereof, it should be appreciated by those of ordinary skill in the art that various modifications to this invention may be made without departing from the spirit and scope of the present.

What is claimed is:

1. A gasketed heat exchanger comprising:

a plurality of heat exchanger plates, wherein each of the heat exchanger plates comprises a plurality of dimples, the plurality of dimples comprising top dimples extending from a first direction of a plane of the heat exchanger plate and bottom dimples extending from a second direction of the plane of the heat exchanger plate that is opposite the first direction, each top dimple comprising a fiat top surface parallel to the plane of the heat exchanger plate at an end of the top dimple distal from the plane of the heat exchanger plate, and each bottom dimple comprising a flat bottom surface parallel to the plane of the heat exchanger plate at an end of the bottom dimple, distal from the plane of the heat exchanger plate, wherein the top dimples of at least one of the heat exchanger plates are connected to the bottom dimples of another neighboring heat exchanger plate, wherein the plurality of dimples are formed of a material configured to be elastically deformable, wherein the top and bottom dimples are elastically deformable in a direction perpendicular to the plane of the heat exchanger plates, wherein the plurality of dimples comprise flanks that are elastically deformed resulting in spring forces acting against external forces, and wherein there are no flat surfaces in the plane of the heat exchanger plate between immediately adjacent dimples, and top and bottom plates, wherein the plurality of heat exchanger plates are arranged between the top and bottom plates, wherein the heat exchanger plates are configured to be held together under a pre-tension by the top and bottom plates, and wherein the flanks are configured to be elastically deformed by the pre-tension of the top and bottom plates without plastic deformation of the flanks so that the elastic deformation is reversible.

2. The gasketed heat exchanger according to claim 1, wherein at least part of the top dimples are arranged in first rows and at least part of the bottom dimples are arranged in second rows.

3. The gasketed heat exchanger according to claim 2, wherein the first rows of dimples with top surfaces alternate with the second rows of dimples with bottom surfaces; and wherein the heat exchanger plate has an elliptical shape between immediately adjacent top surfaces in the first rows of dimples with top surfaces and has an elliptical shape between immediately adjacent bottom surfaces in the second rows of dimples with bottom surfaces.

4. The gasketed heat exchanger according to claim 2, wherein at least part of the first and second rows are arranged parallel to an edge of the heat exchanger plate.

5. The gasketed heat exchanger according to claim 4, wherein at least part of the first and second rows are arranged at an angle to an edge of the heat exchanger plate.

6. The gasketed heat exchanger according to claim 4, wherein at least part of the first and second rows form wedges in the plane of the heat exchanger plate.

7. The gasketed heat exchanger according to claim 2, wherein at least part of the first and second rows are arranged at an angle to an edge of the heat exchanger plate.

8. The gasketed heat exchanger according to claim 2, wherein at least part of the first and second rows form wedges in the plane of the heat exchanger plate.

9. The gasketed heat exchanger according to claim 1, wherein the flat top surface of a top dimple meets the flat bottom surface of a bottom dimple when heat exchanger plates are connected.

10. The gasketed heat exchanger according to claim 9, wherein the plurality of dimples are of a same shape.

11. A gasketed heat exchanger comprising:

a plurality of heat exchanger plates, each heat exchanger plate of the plurality of heat exchanger plates comprising:

a plurality of elastically deformable dimples extending away from a plane of the heat exchanger plate, each elastically deformable dimple of the plurality of dimples being formed of a material configured to be elastically deformable and including:

a flat top or bottom surface parallel to the plane of the heat exchanger plate, the top or bottom surface being elastically deformable in a direction perpendicular to the plane of the heat exchanger plate; and a flank extending from the plane of the heat exchanger plate to the top or bottom surface, the flank configured to be deformed resulting in spring forces acting against external forces;

wherein the plane of the heat exchanger plate does not include flat surfaces in the plane between immediately adjacent dimples of the plurality of dimples;

wherein top surfaces of the plurality of elastically deformable dimples of at least one of the heat exchanger plates are connected to bottom surfaces of the plurality of elastically deformable dimples of another neighboring heat exchanger plate, wherein the plurality of heat exchanger plates are configured to be held together under a pre-tension by top and bottom plates, and wherein the flanks are configured to be elastically deformed by the pre-tension of the top and bottom plates without plastic deformation of the flank so that the elastic deformation is reversible.

12. The gasketed heat exchanger according to claim 11, wherein, in at least a first direction, the top surfaces of the plurality of dimples are arranged in rows and the bottom surfaces of the plurality of dimples are arranged in rows, the rows of top surfaces alternating with the rows of bottom surfaces; and wherein the heat exchanger plate has an elliptical shape between immediately adjacent top surfaces in the rows of top surfaces and has an elliptical shape between immediately adjacent bottom surfaces in the rows bottom surfaces.

13. A gasketed heat exchanger comprising:

a top plate;

a bottom plate;

a plurality of heat exchanger plates arranged between the top plate and the bottom plate, each heat exchanger plate of the plurality of heat exchanger plates comprising:

a plurality of dimples comprising top dimples extending from a plane of the heat exchanger plate in a first direction and bottom dimples extending from the plane of the heat exchanger plate in a second direction that is opposite the first direction, each top dimple comprising a flat top surface parallel to the plane of the heat exchanger plate and each bottom dimple comprising a fiat bottom surface parallel to the plane of the heat exchanger plate, each top dimple and each bottom dimple including a flank extending from the plane of the heat exchanger plate to the flat top or the flat bottom surface;

wherein, in at least a first direction, the top dimples are arranged in rows and the bottom dimples are arranged in rows, the rows of top dimples alternating with the rows of bottom dimples;

wherein there are no straight surfaces in the plane of the heat exchanger plate between the top surfaces of immediately adjacent top dimples in the rows of top dimples;

wherein there are no straight surfaces in the plane of the heat exchanger plate between the bottom surfaces of immediately adjacent bottom dimples in the rows of bottom dimples; and wherein the top surfaces of the top dimples of at least one heat exchanger plate of the plurality of heat exchanger plates are connected to the bottom surfaces of the bottom dimples of another neighboring heat exchanger plate of the plurality of heat exchanger plates, wherein the plurality of heat exchanger plates are configured to be held together under a pre-tension by the top plate and the bottom plate, and wherein the flanks are configured to be elastically deformed by the pre-tension of the top and bottom plates, without plastic deformation of the flanks so that the elastic deformation is reversible.

14. The gasketed heat exchanger according to claim 13, wherein the heat exchanger plate has an elliptical shape between the top surfaces of immediately adjacent top dimples in the rows of top dimples and has an elliptical shape between the bottom surfaces of immediately adjacent bottom dimples in the rows of bottom dimples.

* * * * *